US005722434A

United States Patent [19]

Walker

[11] Patent Number: 5,722,434

[45] Date of Patent: Mar. 3, 1998

[54] HAIR ENHANCEMENT SYSTEM

[76] Inventor: Janice M. Walker, 11807 James Dr., Balch Springs, Tex. 75180

[21] Appl. No.: 639,982

[22] Filed: Apr. 26, 1996

[51] Int. Cl.[6] ..... A41G 3/00; A41G 5/00

[52] U.S. Cl. ..... 132/53; 132/54; 132/56; 132/201

[58] Field of Search ..... 132/53, 54, 55, 132/56, 105, 201; 446/394

[56] References Cited

U.S. PATENT DOCUMENTS

| | | | |
|---|---|---|---|
| 250,967 | 12/1881 | Presser | 132/53 |
| 1,133,196 | 3/1915 | Teugler | 132/53 |
| 1,199,144 | 3/1916 | Zak . | |
| 1,490,479 | 5/1924 | Noel . | |
| 2,574,558 | 2/1951 | Graber et al. | 2/207 |
| 2,651,310 | 9/1953 | Selson . | |
| 3,659,621 | 5/1972 | Tucciarone et al. | 132/53 |
| 3,760,818 | 9/1973 | Schweifer | 132/53 |
| 3,809,100 | 5/1974 | Megna | 132/53 |
| 3,889,414 | 6/1975 | Whetzel | 132/53 |
| 4,016,888 | 4/1977 | Smiley | 132/53 |
| 4,966,173 | 10/1990 | Russell | 132/54 |

FOREIGN PATENT DOCUMENTS

| | | | |
|---|---|---|---|
| 328074 | 10/1920 | Germany | 132/53 |

*Primary Examiner*—Gene Mancene
*Assistant Examiner*—Pedro Philogene
*Attorney, Agent, or Firm*—Joseph N. Breaux

[57] ABSTRACT

A hair enhancement system including a female portion having a first flexible fabric strip having a first plurality of female snap fastener halves secured to and evenly spaced a first spacing distance along a first side surface thereof; a male portion having a second flexible fabric strip having a second plurality of male snap fastener halves that are mateably with the female snap fastener halves of the female portion secured to and evenly spaced by the first spacing distance along a second side surface thereof; and a hair enhancement weft including a third plurality of flexible enhancement hair strands secured to and extending from a side edge of one of said female and male portions along the length thereof. The hair enhancement system is utilized by placing a section of hair from the person having the hair enhancements applied between the female or male portions and snapping the female snap fastener strip to the male snap fastener strip in a manner to retain the section of hair from the person therebetween.

5 Claims, 3 Drawing Sheets

HAIR ENHANCEMENT SYSTEM

TECHNICAL FIELD

The present invention relates to hair enhancement systems and more particularly to a hair enhancement system having snap connected hair enhancement portions that are snap fit to a weft of existing hair.

BACKGROUND ART

Increasing the fullness and length of hair has been accomplished in a variety of manners. Individuals have created wigs to cover large areas of scalp with a desired type, length, color or thickness of hair. In addition, hair enhancement pieces are secured to a harness worn over the scalp of a user. However, these methods tend to cover extensive areas of the scalp and can be uncomfortable to wear. It would be desirable, therefore, to have a hair enhancement system that could be used to provide as little or as much hair enhancement as desired. It would be a further benefit, to have a hair enhancement system that could be tailored to a user by a cosmetologist or the like. It would be a further benefit, if the hair enhancements were provided in a roll and could be dispensed to a desired length according to the desires of a particular patron.

GENERAL SUMMARY DISCUSSION OF INVENTION

It is thus an object of the invention to provide a hair enhancement system that can be used to provide as little or as much hair enhancement as desired.

It is a further object of the invention to provide a hair enhancement system that can be tailored to a user by a cosmetologist or the like.

It is a still further object of the invention to provide a hair enhancement system that is provided in a roll and can be dispensed to a desired length according to the desires of a particular patron receiving the hair enhancements.

Accordingly, a hair enhancement system is provided. The hair enhancement system comprises a female portion having a first flexible fabric strip having a first plurality of female snap fastener halves secured to and evenly spaced a first spacing distance along a first side surface thereof; a male portion having a second flexible fabric strip having a second plurality of male snap fastener halves that are mateably with the female snap fastener halves of the female portion secured to and evenly spaced by the first spacing distance along a second side surface thereof; and a hair enhancement weft including a third plurality of flexible enhancement hair strands secured to and extending from a side edge of one of said female and male portions along the length thereof. The term "enhancement hair strands" as used herein means natural human hair as well as conventional false hair substitutes commonly used for hair enhancement purposes. The hair enhancement system is utilized by placing a section of hair from the person having the hair enhancements applied between the first and second surfaces with the female or male portion having the enhancement weft secured thereto farthest from the scalp of the person and snapping the female snap fastener strip to the male snap fastener strip in a manner to retain the section of hair from the person therebetween. The first spacing distance is preferably between one-eighth (⅛") and three-eighths (⅜") inches.

In a preferred embodiment, both the female and male portions include enhancement hair wefts secured thereto. In another preferred embodiment, at least one of the female and male portions has a hair enhancement weft extending from to side edges thereof. The female and male portions are also preferably packaged in a continuous length wound upon a dispensing spool. This allows a cosmetologist or the like to provide the desired lengths of female and male portions required without waste.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
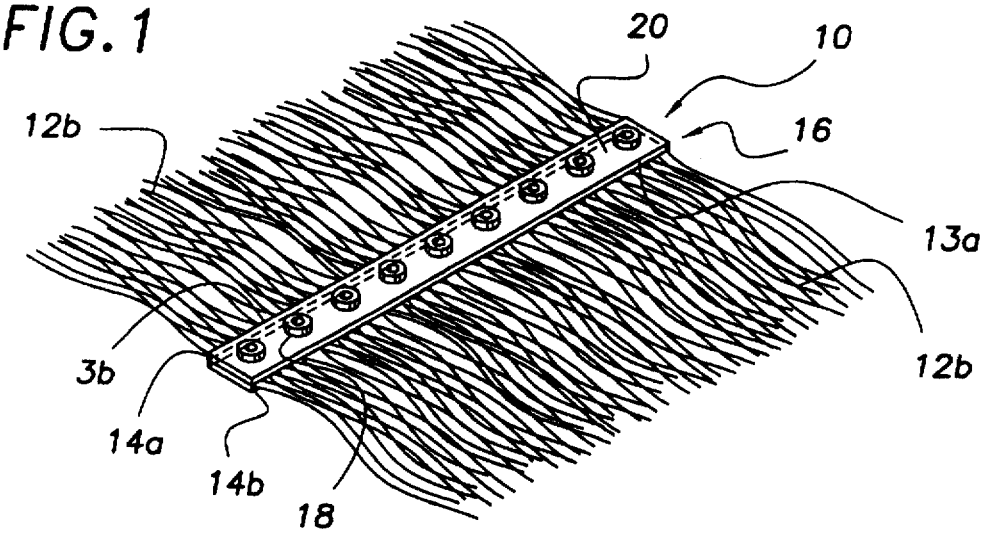
FIG. 1 is a perspective view of a first exemplary embodiment of the female portion of the hair enhancement system of the present invention showing a pair of hair enhancement wefts secured to a female snap fastener strip.

FIG. 1 shows a first exemplary embodiment of the female portion of the hair enhancement system of the present invention, generally designated by the numeral 10. Female portion 10 includes a pair of hair enhancement wefts **12*a*, 12*b* formed from human hair strands stitched between two strips 14*a*,14*b* of nylon webbing that form a portion of a female snap fastener strip, generally designated by the numeral 16. Enhancement hair weft 12*a* extends from a first side edge 13*a* of female snap fastener strip 16. Enhancement hair weft 12*b* extends from a second side edge 13*b* of female snap fastener strip 16. In this embodiment, female snap fastener strip 16 has nine female snap fastener halves 18 stitched to a first outer surface 20** and spaced about one-quarter inch apart.

Figure 2:
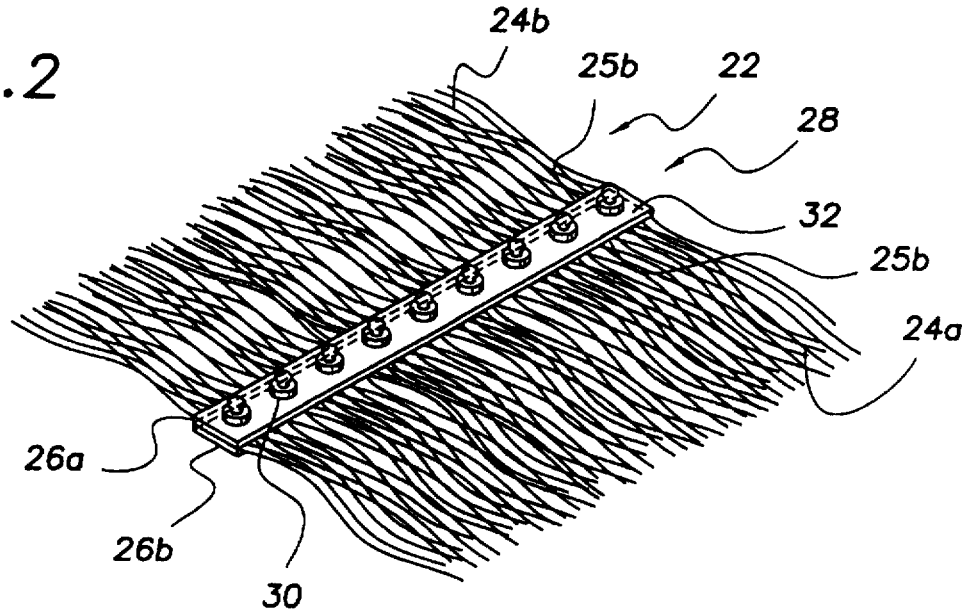
FIG. 2 is a perspective view of a first exemplary embodiment of the male portion of the hair enhancement system of the present invention showing a pair of hair enhancement wefts secured to a male snap fastener strip.

FIG. 2 shows a first exemplary embodiment of the male portion of the hair enhancement system of the present invention, generally designated by the numeral 22. Male portion 22 includes a pair of hair enhancement wefts **24*a*, 24*b* formed from human hair strands stitched between two strips 26*a*,26*b* of nylon webbing that form a portion of a male snap fastener strip, generally designated by the numeral 28. Enhancement hair weft 24*a* extends from a third side edge 25***a* of male snap fastener strip 28. Enhancement hair weft 24*b* extends from a fourth side edge 25*b* of male snap fastener strip 28. In this embodiment, male snap fastener strip 28 has nine male snap fastener halves 30 stitched to a second outer surface 32 and spaced about one-quarter inch apart. Male snap fastener halves 30 are mateable with female snap fastener halves 18 to secure female portion 10 to male portion 22 in use.

Figure 3:
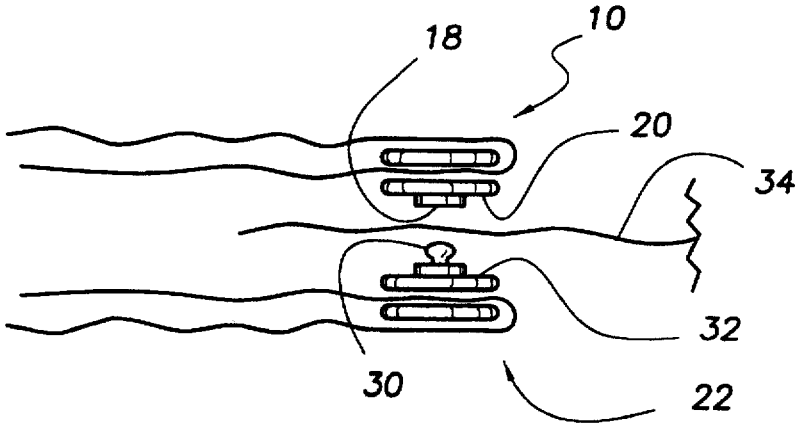
FIG. 3 is a side view illustrating attachment of the female portion of FIG. 1 and the male portion of FIG. 2 to a representative weft of hair.

Use of female portion 10 and male portion 22 is now described with reference to FIG. 3. The hair enhancement system is applied by separating a natural weft of hair 34 from the head of the person receiving the hair enhancements and placing the natural weft of hair 34 between female portion 10 and male portion 22 in a manner such that the natural hair weft 34 is between first outer surface 20 and second outer surface 32 and then snapping female snap fastener halves 18 to male snap fastener halves 30.

Figure 4:
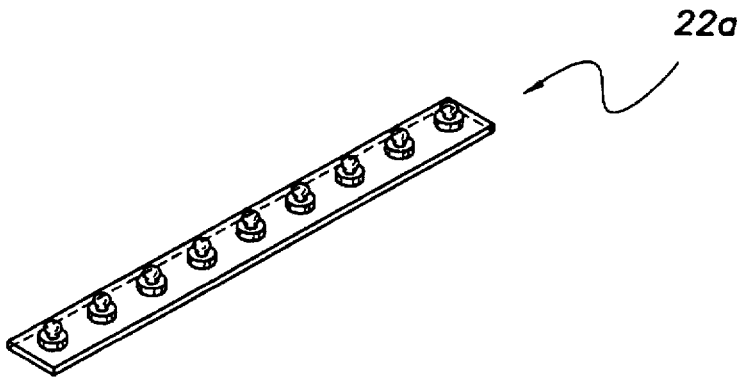
FIG. 4 is a perspective view of a second exemplary embodiment of the male portion of the hair enhancement system of the present invention showing a male snap fastener strip having no hair enhancement wefts.
Figure 5:
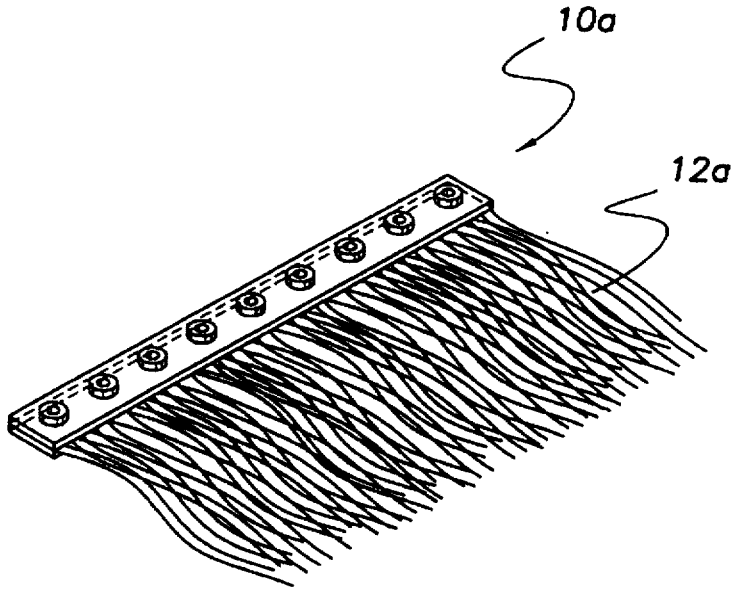
FIG. 5 is a perspective view of a second exemplary embodiment of the female portion of the hair enhancement system of the present invention having a single hair enhancement weft secured to a female snap fastener strip.
Figure 6:
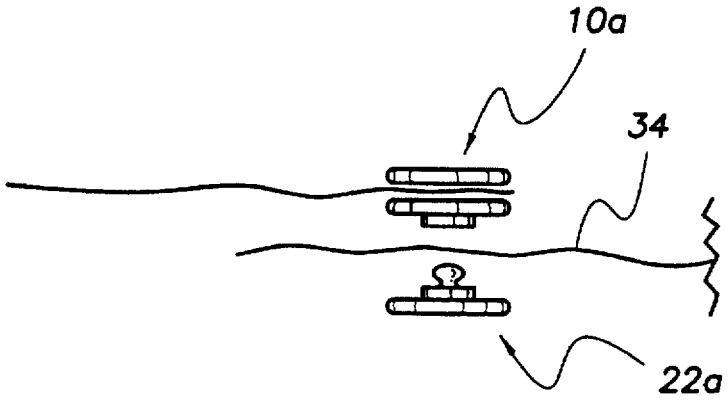
FIG. 6 is a side view illustrating attachment of the female portion of FIG. 5 and the male portion of FIG. 4 to a representative weft of hair.

FIG. 4 shows a second exemplary male portion 22*a* that constructed identically to first exemplary male portion 22 except that no hair wefts 24*a*,24*b* are secured thereto. FIG. 5 shows a second exemplary embodiment of female portion 10*a* that is constructed identically to first exemplary female portion 10 except that only one hair enhancement weft 12*a* is used. FIG. 6 illustrates securement of male portion 22*a* and female portion 10*a* to natural hair weft 34. When a male portion 22*a* having no enhancement wefts secured thereto is used, male portion 22*a* is placed on the side of natural hair weft 34 that is closest to the scalp of the wearer in use. Of course, if a female portion is constructed without an enhancement hair weft it should be placed on the side of natural hair weft 34 that is closest to the scalp of the wearer in use.

Figure 7:
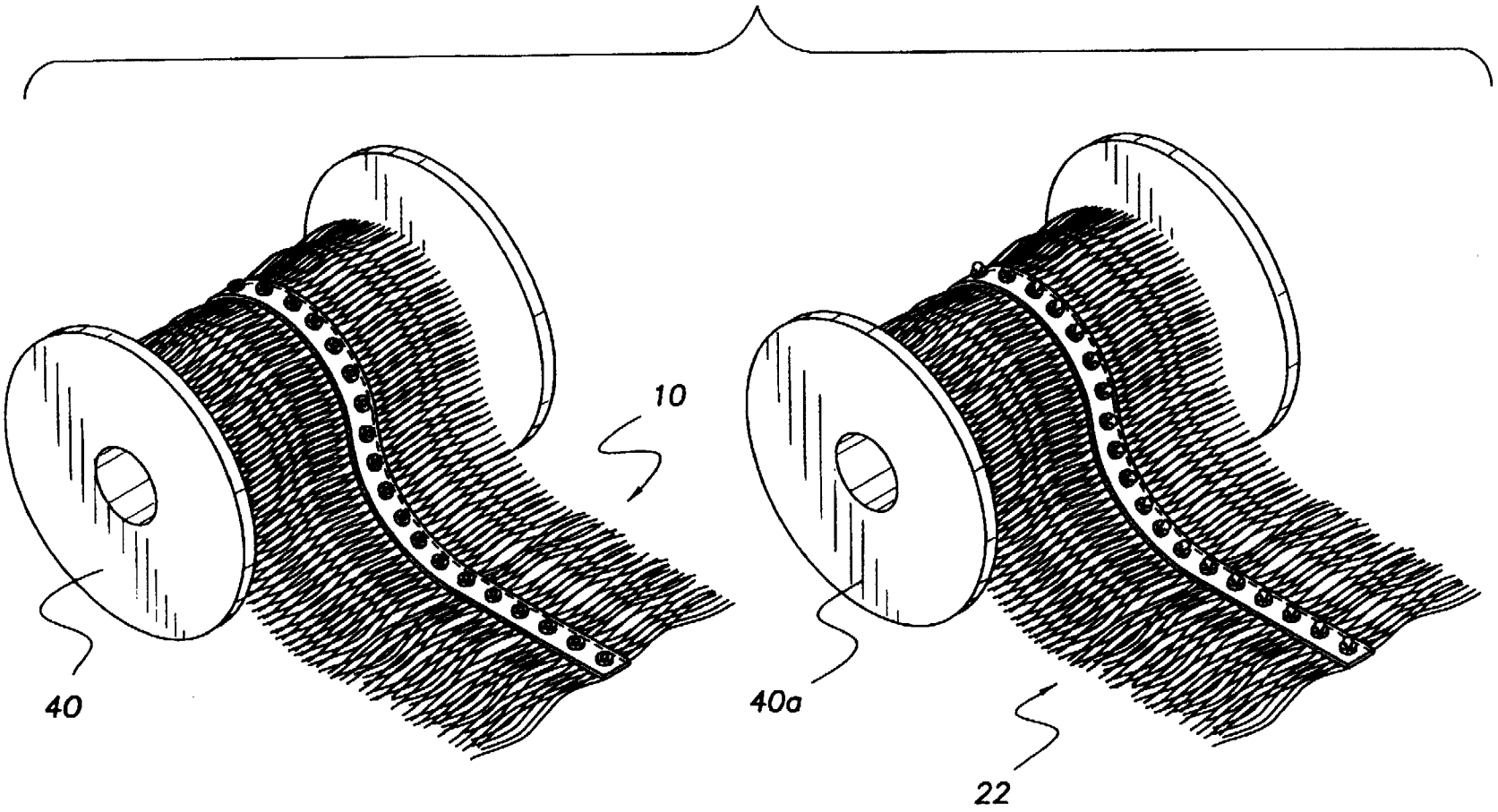
FIG. 7 is a perspective view of an exemplary embodiment of a length of female portion of FIG. 1 wound about a first dispensing spool an n exemplary embodiment of a length of male portion of FIG. 2 wound onto a second dispensing spool, the first and second dispensing spools being identical.

FIG. 7 shows first exemplary female portion 10 wound upon a first dispensing spool 40 for dispensing desired lengths of female portion 10 when desired. Also shown in the figure is a first exemplary male portion 22 wound upon a second dispensing spool 40*a* for dispensing lengths of male portion 22 when desired. First and second dispensing spools 40,40*a* are of identical, conventional spool construction.

It can be seen from the preceding description that a hair enhancement system has been provided that can be used to provide as little or as much hair enhancement as desired; that can be tailored to a user by a cosmetologist or the like; and that can be provided on a roll and dispensed to a desired length according to the desires of a patron receiving the hair enhancements.

It is noted that the embodiment of the hair enhancement system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair enhancement system comprising:

a female portion having a first flexible fabric strip having a first plurality of female snap fastener halves secured to and evenly spaced a first spacing distance along a first side surface thereof;

a male portion having a second flexible fabric strip having a second plurality of male snap fastener halves that are mateably with said female snap fastener halves of said female portion secured to and evenly spaced by said first spacing distance along a second side surface thereof;

a first hair enhancement weft including a third plurality of flexible enhancement hair strands secured to and extending from a side edge of one of said female and male portions along a first length thereof;

a first spool member; and a second spool member;

said female portion being wound upon said first spool member, said male portion being wound upon said second spool member.

2. A hair enhancement system comprising:

a female portion having a first flexible fabric strip having a first plurality of female snap fastener halves secured to and evenly spaced a first spacing distance along a first side surface thereof, said first spacing distance being between one-eighth (⅛") and three-eighths (⅜") inches;

a male portion having a second flexible fabric strip having a second plurality of male snap fastener halves that are mateably with said female snap fastener halves of said female portion secured to and evenly spaced by said first spacing distance along a second side surface thereof;

a first hair enhancement weft including a third plurality of flexible enhancement hair strands secured to and extending from a side edge of one of said female and male portions along a first length thereof;

a first spool member; and a second spool member;

said female portion being wound upon said first spool member, said male portion being wound upon said second spool member.

3. The hair enhancement system of claim 2 further including:

a second hair enhancement weft; and wherein:

said female and male portions both have an enhancement hair wefts secured thereto.

4. The hair enhancement system of claim 2 further including:

a second hair enhancement weft; and wherein one of said female and male portions has said first hair enhancement weft extending from a first side edge thereof and said second hair enhancement weft extending from a second side edge thereof.

5. The hair enhancement system of claim 4, wherein:

said first length is equal to the length of said side edge.

* * * * *